US009464398B2

(12) United States Patent
Korherr et al.

(10) Patent No.: US 9,464,398 B2
(45) Date of Patent: Oct. 11, 2016

(54) PILE-DRIVING APPARATUS AND METHOD FOR DRIVING A PILE ELEMENT INTO THE GROUND

(71) Applicant: BAUER Maschinen GmbH, Schrobenhausen (DE)

(72) Inventors: Werner Korherr, Koenigsmoss (DE); Juergen Heilgemeir, Petersdorf (DE); Michael Meixner, Hofstetten (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 0 days.

(21) Appl. No.: 14/864,599

(22) Filed: Sep. 24, 2015

(65) Prior Publication Data

US 2016/0090707 A1 Mar. 31, 2016

(30) Foreign Application Priority Data

Sep. 25, 2014 (EP) ..... 14186393

(51) Int. Cl.

| | |
|---|---|
| ***E02D 7/06*** | (2006.01) |
| ***E02D 7/08*** | (2006.01) |
| ***E02D 7/10*** | (2006.01) |
| ***E02D 7/12*** | (2006.01) |
| ***E02D 11/00*** | (2006.01) |
| ***E02D 13/00*** | (2006.01) |

(52) U.S. Cl.

CPC . *E02D 7/08* (2013.01); *E02D 7/10* (2013.01); *E02D 7/125* (2013.01); *E02D 11/00* (2013.01); *E02D 13/00* (2013.01); *E02D 7/06* (2013.01)

(58) Field of Classification Search

CPC ..... E02D 7/02; E02D 7/06; E02D 7/08; E02D 7/10; E02D 7/14; E02D 7/16; E02D 7/165

See application file for complete search history.

(56) References Cited

U.S. PATENT DOCUMENTS

| | | | | |
|---|---|---|---|---|
| 2,134,989 A | | 11/1938 | Templeton | |
| 3,365,004 A | * | 1/1968 | Johansson | E02D 7/16 173/195 |
| 3,827,508 A | * | 8/1974 | MacKinnon | E02D 7/14 173/112 |
| 4,022,433 A | * | 5/1977 | Kondo | E02D 7/08 173/88 |
| 5,375,664 A | * | 12/1994 | McDowell | E02D 7/18 173/1 |
| 2005/0247461 A1 | * | 11/2005 | Cardoso | E02D 13/06 173/13 |

(Continued)

FOREIGN PATENT DOCUMENTS

| | | | | |
|---|---|---|---|---|
| DE | 3328159 A1 | * | 2/1985 | E02D 7/14 |
| GB | 771037 A | | 3/1957 | |
| GB | 938592 A | * | 10/1963 | E02D 7/16 |

(Continued)

OTHER PUBLICATIONS

European Search Report issued in Patent Application No. 14 18 6393, mailed Mar. 4, 2015.

*Primary Examiner* — Frederick L Lagman

(74) *Attorney, Agent, or Firm* — Studebaker & Brackett PC

(57) ABSTRACT

A pile-driving apparatus and a method for driving a pile element into the ground, wherein a head region of the pile element is arranged in a driving helmet on an underside of a driven hammer unit, which is moved by a main winch and a main rope along a mast and drives the pile element in a vertical driving position into the ground. The pile element is hoisted by an auxiliary winch with auxiliary rope from a lying position into the approximately vertical driving position, in which the head region of the pile element is received in the driving helmet of the hammer unit.

9 Claims, 3 Drawing Sheets

(56) References Cited

U.S. PATENT DOCUMENTS

Figure 1:
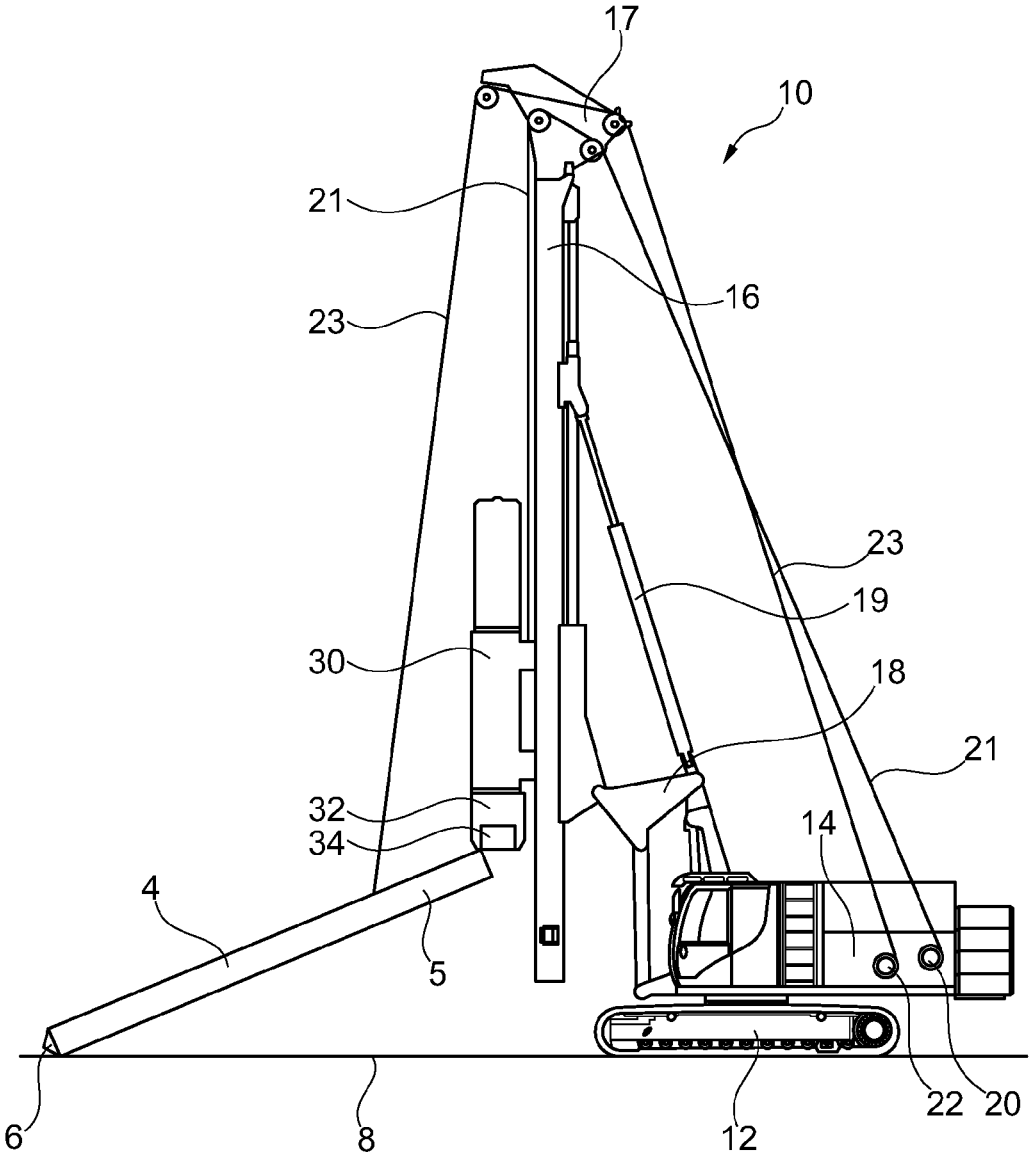

| | | | | |
|---|---|---|---|---|
| 2005/0281625 | A1* | 12/2005 | Mignacca | E02D 5/72 405/255 |
| 2008/0044236 | A1* | 2/2008 | Lloyd | E02D 7/16 405/232 |

FOREIGN PATENT DOCUMENTS

| | | | |
|---|---|---|---|
| SU | 1188245 | * 10/1985 | E02S 7/06 |
| SU | 1357500 | * 12/1987 | E02D 7/08 |

* cited by examiner

PILE-DRIVING APPARATUS AND METHOD FOR DRIVING A PILE ELEMENT INTO THE GROUND

The invention relates to a pile-driving apparatus for driving a pile element into the ground with a mast, a driven hammer unit which is supported in a movable manner along the mast and has a driving helmet in a lower region which is designed for receiving a head region of the pile element to be driven in, a main winch with main rope which is connected to the hammer unit for moving the hammer unit along the mast, and an auxiliary winch with auxiliary rope which is guided over the mast and can be connected to a pile element to be driven in, wherein by means of the auxiliary winch the pile element to be driven in can be hoisted from a lying position into an approximately vertical driving position, in which the head region of the pile element is received in the driving helmet of the hammer unit, in accordance with the preamble of claim 1.

The invention furthermore relates to a method for driving a pile element into the ground, wherein a head region of the pile element is arranged in a driving helmet on an underside of a driven hammer unit, which is moved by means of a main winch with a main rope along a mast and drives the pile element in an approximately vertical driving position into the ground, wherein the pile element is hoisted by means of an auxiliary winch with auxiliary rope from a lying position into the approximately vertical driving position, in which the head region of the pile element is received in the driving helmet of the hammer unit, in accordance with the preamble of claim 7.

Such pile-driving apparatuses and such methods are used in foundation operations, in which pile elements are driven into relatively soft ground. For this purpose, the pile-driving apparatus has a hammer unit which, depending on the type of drive, can be a so-called diesel hammer or a hydraulic hammer. The hammer unit generates impact pulses that are applied to the head region of a pile element so that the pile element is driven into the ground.

For such a driving operation it is necessary for the pile element to be initially brought into an approximately vertical driving position, in which an upper head region of the pile element is received in a driving helmet of the hammer unit. By way of the cup-shaped driving helmet the impact pulses are transferred to the pile element.

The pile elements, which normally consist of steel or concrete, initially have to be hoisted from a typical lying transport or storage position into the vertical operating or driving position. To this end, provision is made on the mast of the pile-driving apparatus for an auxiliary winch with auxiliary rope, the free end of which is fixed in an upper region of the pile element so that the pile element can be hoisted with the auxiliary winch from the lying position into the vertical driving position.

This hoisting of the pile element as well as the necessary threading of the head of the pile element into the driving helmet requires a high degree of experience and skill on the part of an operator. In addition to controlling the auxiliary winch it is in some cases necessary to bring the pile element manually into the precise position below the hammer unit. Moreover, for a threading into the driving helmet it is required that, in addition to the auxiliary winch, the position of the hammer unit on the mast must also be adjusted by a main winch in a coordinated manner.

These threading operations are time-consuming and require a large amount of human resources and, furthermore, manual adjusting operations of the pile element carried out in the direct work range of the pile-driving apparatus are to be avoided where possible for operational safety reasons.

Furthermore, when the pile element is hoisted into the driving position by the auxiliary winch there is the risk that the pile element, which is up to 10 m and more in length, is set into a swinging or oscillating movement on the auxiliary rope. An oscillating pile element can damage the pile-driving apparatus or the connection to the auxiliary rope can be cut which can also lead to material damage or even personal injury.

The invention is based on the object to provide a pile-driving apparatus and a method for driving a pile element, with which an efficient and particularly secure operation is rendered possible.

The object is achieved on the one hand by a pile-driving apparatus having the features of claim 1 and on the other hand by a method having the features of claim 7. Preferred embodiments of the invention are stated in the respective dependent claims.

The pile-driving apparatus according to the invention is characterized in that a control means is provided for the simultaneous automatic control of the main winch and the auxiliary winch and that during hoisting of the pile element to be driven in, the main winch and the auxiliary winch are controlled by the control means so that the hammer unit can be moved by the main winch from a lower starting position on the mast and, during hoisting by means of the auxiliary winch, the head region of the pile element rests with a predeterminable pressing force against the driving helmet.

A first aspect of the invention resides in the fact that during hoisting of the pile element from a lying position into the driving position a head region of the pile element rests in a defined manner against the driving helmet of the hammer unit. Hence, during hoisting the pile element is in constant contact with the ground on the one hand and with the driving helmet on the other hand. Through this multiple contacting the risk of swinging of the pile element during the hoisting process is effectively prevented.

Another aspect of the invention resides in the fact that the pile element resting with a defined pressing force against the driving helmet during the hoisting process is controlled by a control means through a simultaneous automatic control of the main winch for adjustment of the hammer unit and of the auxiliary winch for adjustment of the pile element. This ensures an efficient, reliable and therefore secure operation during hoisting of the pile element. Within the meaning of the invention the predeterminable pressing force is not a single force value but preferably a force value range predetermined by a lower minimum value and an upper maximum value. The minimum value must be dimensioned such that the pile element remains safely on the driving helmet during the hoisting process while the maximum value is chosen such that the driving helmet is not damaged by the pressing force.

A preferred embodiment of the invention resides in the fact that the control means has an input means for setting the pressing force. Advantageously, the input means can be a simple control unit or a potentiometer, with which an operator controls the auxiliary winch and/or the main winch in such a way that a desired pressing force of the pile element on the driving helmet is brought about. In addition to such an infinitely variable input means provision can also be made for preset keys with standard pressing force values. Basically, it is also possible to provide a keyboard, whereby the pressing force can be predetermined numerically.

Basically, the winches can be driven in any chosen manner. A particularly advantageous embodiment of the invention results from the fact that the main winch and the auxiliary winch each have a hydraulic motor and that through the control means the supply of hydraulic fluid to one of the hydraulic motors or to both hydraulic motors is controlled for setting the pressing force. On the one hand, hydraulic motors are especially compact and enable an efficient application of force. On the other hand, the control effected by changing the supply of hydraulic fluid to a hydraulic motor, e.g. by changing the volume flow or the hydraulic pressure, permits a quick and precise control of the winch drives.

An advantageous further development of the invention results from the fact that for the control of the at least one hydraulic motor a hydraulic pressure control valve is arranged in a supply line, which can be actuated by way of the control means. By preference, the hydraulic pressure control valve is only located in the supply line to one hydraulic motor, more particularly the hydraulic motor of the main winch. As a result, the rotational speed and/or the pulling force of the winch can be set very accurately.

According to a further embodiment of the invention it is of advantage that during hoisting of the pile element the auxiliary winch is operated at a higher rotational speed and/or pulling force than the rotational speed or pulling force of the main winch. This ensures that the pile element rests reliably at all times with the desired pressing force against the driving helmet of the hammer unit. In particular, this prevents the hammer unit from being moved too rapidly upwards by the main winch and the head region of the pile element losing contact with the driving helmet. Moreover, the auxiliary winch must be controlled or set in such a way that a tip of the pile element is supported on the ground.

According to an embodiment of the invention a further improvement in operability is achieved in that the control means has a switch which can be switched between an individual control of main winch and auxiliary winch and a joint automatic control. In this case, the control means can have a portable manual unit, on which the input means and the switch are arranged. In this way, an operator still has the possibility of operating and adjusting the main winch and thus the hammer unit as well as the auxiliary winch and thus the pile element in an independent manner. However, for a secure and reliable hoisting the operator can switch to the automatic control so that after an initial adjustment and positioning of the head region of the pile element on the driving helmet an automatic hoisting and threading of the pile element on the hammer unit is carried out.

The method according to the invention for driving a pile element into the ground is characterized in that during hoisting of the pile element to be driven in, the main winch and the auxiliary winch are controlled automatically in a simultaneous manner by a control means so that during hoisting the head region of the pile element rests with a predeterminable pressing force against the driving helmet.

The method can be carried out in particular by means of the pile-driving apparatus described beforehand. By way of the method according to the invention the advantages set out beforehand can be attained.

Basically, a predetermined pressing force can be stored in the control means. According to a variant of the invention it is preferred that the pressing force is set by means of the control means. This can take place by way of a control unit, in particular a potentiometer, or via a numerical input field. In this way, the pressing force can be adapted to different dimensions and weights of the pile element.

For the pressure setting an advantageous embodiment variant of the invention resides in the fact that for the setting of the pressing force the auxiliary winch is actuated and the pile element is pressed against the driving helmet while the main winch is stopped and the hammer unit is in a lower starting position on the mast and that subsequently the main winch and the auxiliary winch are actuated by the control means, wherein the hammer unit is moved along the mast from the lower starting position into an upper driving position while the pile element is pressed continuously against the driving helmet. Thus, in practice the setting of the pressing force can be carried out by the operator through a simple adjustment and pressing of the pile element against the driving helmet while the hammer unit is located in a lower starting position on the mast.

Basically, on the winch or the driving helmet a measuring means, in particular a sensor means, can also be provided, with which the current pressing force is indicated. However, such a measuring means is not absolutely necessary.

After this preliminary adjustment of the pile element along with a pressing against the driving helmet the hoisting process can commence, in which case the hammer unit is moved upwards in a controlled manner by the main winch while the synchronously controlled auxiliary winch continues to press the pile element against the upward-moving hammer unit until the pile element reaches the vertical end position and is threaded into the cylindrical receiving space of the cup-shaped driving helmet. Then the drive of both winches is stopped. If necessary, the hammer unit is lowered with respect to the driving element until an adequate impact contact surface is reached between the driving helmet and the upper head region of the pile element. In the driving position the hammer unit can then be put into operation and the pile element can be driven into the ground through a downward movement of the hammer unit.

Another preferred method variant of the invention resides in the fact that during hoisting a supply of hydraulic fluid to a hydraulic motor of the main winch and/or the auxiliary winch is controlled. This permits a particularly precise and quick control of the winch operation.

According to a further embodiment of the invention it is of advantage that the auxiliary winch is operated at a predetermined speed and/or pulling force and that for the generation of the pressing force the main winch is operated at a speed and/or pulling force that can be set by the control means. Thus, the auxiliary winch has a predetermined fixed setting. Hence, the pressing force is set by way of the control through a corresponding setting of the speed and/or pulling force of the main winch with the main rope.

Basically, a fixed setting of the main winch is also possible, while the setting is effected through a corresponding change of the auxiliary winch drive.

Figure 2:
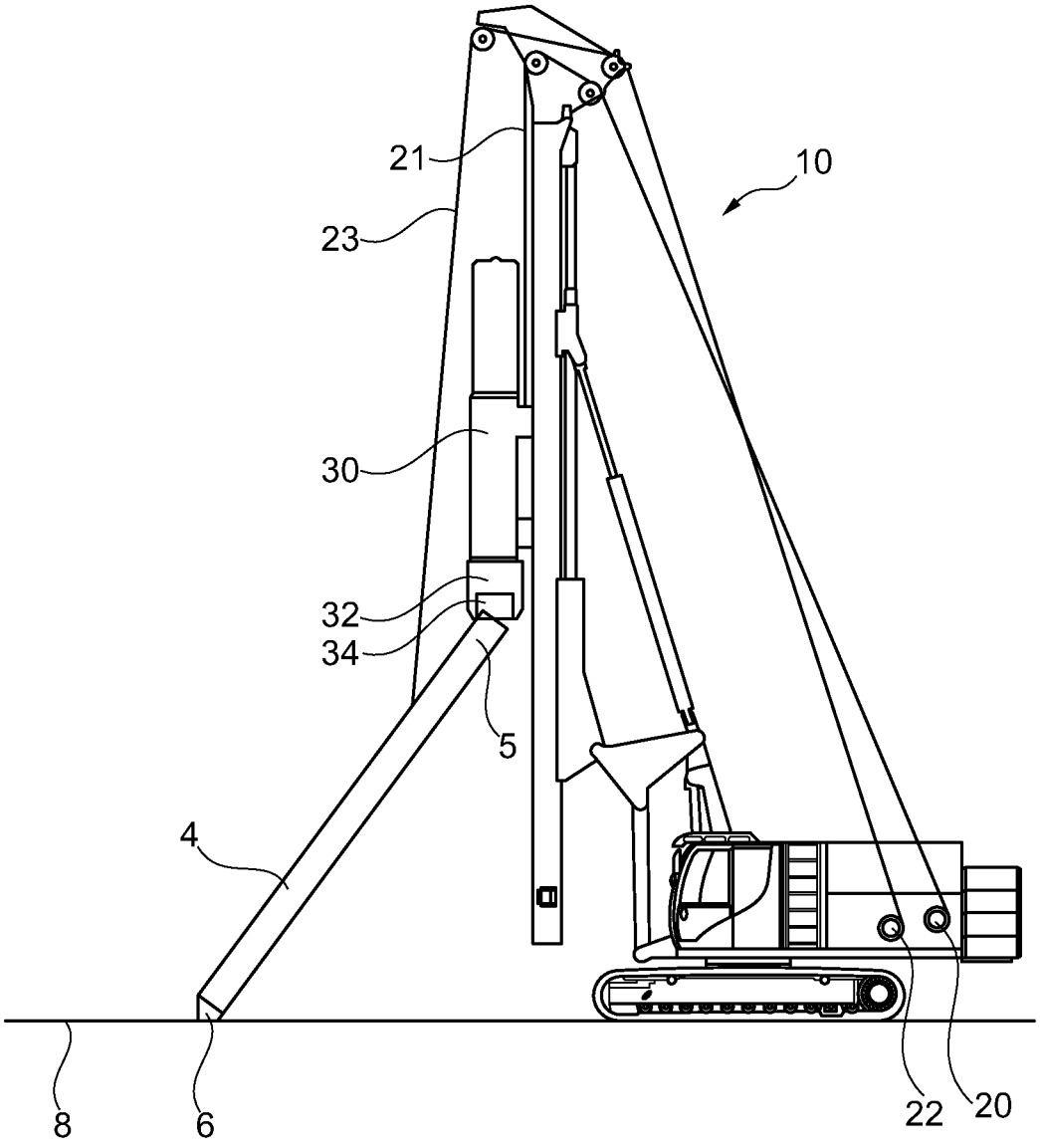
Figure 3:
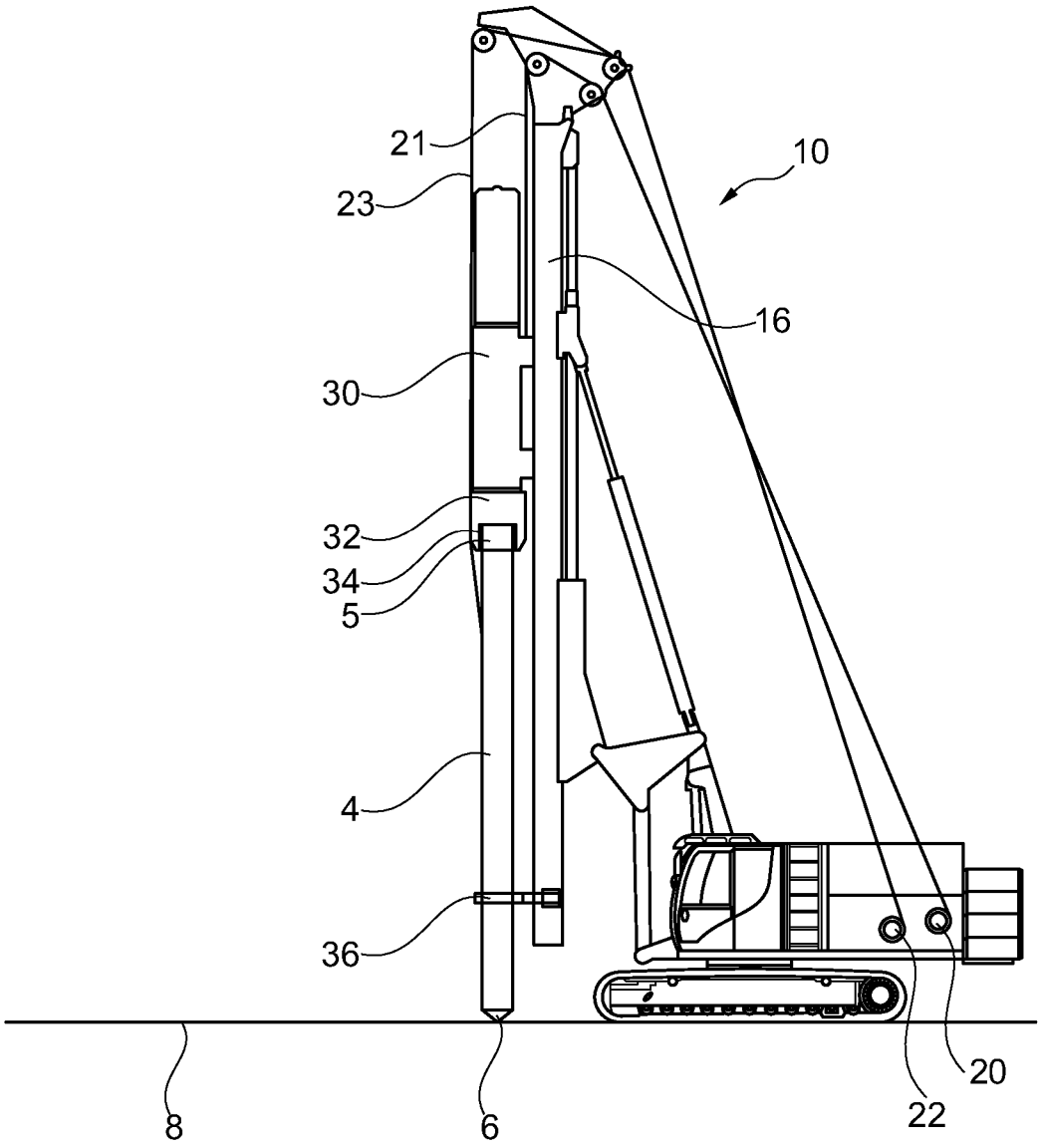

In the following the invention is described by way of a preferred embodiment illustrated schematically in the drawings, wherein show:

FIG. 1: a side view of a pile-driving apparatus according to the invention during hoisting of a pile element in a starting position;

FIG. 2: a side view of the pile-driving apparatus of FIG. 1 during hoisting of the pile element; and FIG. 3: a side view of the pile-driving apparatus of FIGS. 1 and 2 with hoisted pile element in a driving position.

In FIGS. 1 to 3 the progress of a method according to the invention is illustrated which is carried out by way of a pile-driving apparatus 10 according to the invention. The pile-driving apparatus 10 has an undercarriage 12 designed as a crawler-track running gear and an upper carriage 14 supported thereon in a rotatable manner. On the upper carriage 14 a mast 16 with mast head 17 is adjustably mounted in a known manner via a kinematic linkage 18 with positioning cylinder 19. In the operating position the mast 16 is in vertical alignment which is shown in FIG. 1.

On a front side of the mast 16 a linear guide, not shown, is provided, along which a hammer unit 30 is guided and supported in a vertically displaceable manner. To move the hammer unit 30 a main winch 20 is arranged in the upper carriage 14, which is connected to the hammer unit 30 via a main rope 21 guided over the mast head 17. The main winch 20 is driven by a hydraulic motor not shown.

The hammer unit 30 has an impact unit in a known manner which is driven by an impact drive, such as a diesel engine or a hydraulic drive, in order to generate impact pulses. On an underside of the hammer unit 30 a cup-shaped driving helmet 32 is arranged, the approximately cylindrical receiving space 34 of which is open in the downward direction. The receiving space 34 is designed to receive a head region 5 of a pile element 4 to be driven in so as to transfer the impact pulses generated by the hammer unit 30 via the driving helmet 32 to the pile element 4.

To implement the pile-driving method the pile element 4 initially needs to be moved from a lying storage or transport position, in which the pile element 4 normally is directed horizontally, into an approximately vertically directed operating or driving position, in which the head region 5 of the pile element 4 is threaded into the receiving space 34 of the driving helmet 32, as shown in FIG. 3.

For this necessary hoisting of the pile element 4 an auxiliary winch 22 with an auxiliary rope 23, which is guided via rollers on the mast head 17, is provided on the upper carriage 14 in addition to the main winch 20. The free end of the auxiliary rope 23 is fixed in a manner known per se, for instance by way of a hook means, on the pile element 4 in an upper region thereof. For the hoisting the hammer unit 30 is initially moved on the mast 16 into a lower starting position which is illustrated by approximation in FIG. 1. Through actuation of the auxiliary winch 22 driven by a hydraulic motor by an operator the head region 5 of the pile element 4 is hoisted while a tip 6 of the pile element 4 is supported on the ground 8.

Through individual control effected by an operator the pile element 4 is hoisted with the auxiliary winch 22 until the head region 5 of the pile element 4 rests with a desired pressing force against the underside of the driving helmet 32. The pressing force can be predetermined by the operator on the basis of his experience or specified and set on the auxiliary winch 22 by a measuring means with a force-measuring sensor.

After the starting condition according to FIG. 1 has been reached, according to the invention an automatic control program is activated in the control means of the pile-driving apparatus 10, as a result of which the main winch 20 and the auxiliary winch 22 are henceforth actuated in a defined manner in order to hoist the pile element 4. In this process, the main rope 21 and the auxiliary rope 23 are drawn in synchronously in a coordinated manner so that the hammer unit 30 moves upwards along the mast 16. At the same time, the pile element 4 is being pulled upwards by the auxiliary rope 23, with the control being effected such that the head region 5 of the pile element 4 constantly rests with the desired pressing force against the driving helmet 32. Since the pile element 4 continues to be supported via the tip 6 on the ground 8 this double support of the pile element 4 during the hoisting movement prevents the pile element 4 from getting into an undesired swinging.

As can be taken from the illustration according to FIG. 2, during this controlled upward pulling of pile element 4 and hammer unit 30 the head region 5 of the pile element 4 is gradually threaded into the receiving space 34 of the driving helmet 32. In the cylindrical wall region surrounding the receiving space 34 the driving helmet 32 can have a lead-in slope, not shown, which is directed towards the receiving space 34 and through which the inclined insertion of the head region 5 into the receiving space 34 is facilitated.

The upward pulling of the pile element 4 and the hammer unit 30 continues until the operating and driving position shown in FIG. 3 is reached. In the driving position the pile element 4 is arranged in an approximately vertical manner and the head region 5 of the pile element 4 is received so as to fit into the receiving space 34 of the driving helmet 32. For additional guidance of the pile element 4 a guide and retaining clamp 36 mounted in a lower region of the mast 16 can be pivoted towards the pile element 4 in order to additionally guide the latter during the subsequent driving process.

Afterwards, the pile element 4 can be driven to a desired depth into the ground 8.

The invention claimed is:

1. Pile-driving apparatus for driving a pile element into the ground comprising a mast, a driven hammer unit which is supported in a movable manner along the mast and has a driving helmet in a lower region which is designed for receiving a head region of the pile element to be driven in, a main winch with main rope which is connected to the hammer unit for moving the hammer unit along the mast, and an auxiliary winch with auxiliary rope which is guided over the mast and is be connected to a pile element to driven in, wherein by means of the auxiliary winch the pile element to be driven in is hoisted from a lying position into an approximately vertical driving position, in which the head region of the pile element is received in the driving helmet of the hammer unit, wherein a control means is provided for the simultaneous automatic control of the main winch and the auxiliary winch, during hoisting of the pile element to be driven in, the main winch and the auxiliary winch are controlled by the control means so that the hammer unit is moved by the main winch from a lower starting position on the mast and, during hoisting by means of the auxiliary winch, the head region of the pile element rests with a predeterminable pressing force against the driving helmet, the main winch and the auxiliary winch each have a hydraulic motor, and through the control means the supply of hydraulic fluid to one of the hydraulic motors or to both hydraulic motors is controlled for setting the pressing force.

2. Pile-driving apparatus according to claim 1, wherein the control means has an input means for setting the pressing force.

3. Pile-driving apparatus according to claim 1, wherein for the control of the at least one hydraulic motor a hydraulic pressure control valve is arranged in a supply line, which is actuated by way of the control means.

4. Pile-driving apparatus according to claim 1,
wherein
during hoisting of the pile element the auxiliary winch is operated at a higher rotational speed and/or pulling force than the rotational speed or pulling force of the main winch.

5. Pile-driving apparatus according to claim 1,
wherein
the control means has a switch, which is switched between an individual control of main winch and auxiliary winch and a joint automatic control.

6. Method for driving a pile element into the ground with a pile-driving apparatus according to claim 1,
arranging a head region of the pile element in a driving helmet on an underside of a driven hammer unit,
moving the head region by means of a main winch with a main rope along a mast and drives the pile element in an approximately vertical driving position into the ground,
hoisting the pile element by means of an auxiliary winch with auxiliary rope from a lying position into the approximately vertical driving position, and
receiving the head region of the pile element in the driving helmet of the hammer unit,
wherein
during hoisting of the pile element to be driven in, the main winch and the auxiliary winch are controlled automatically in a simultaneous manner by a control means so that during hoisting, the head region of the pile element rests with a predetermined pressing force against the driving helmet, and
during hoisting, controlling a supply of hydraulic fluid to a hydraulic motor of the main winch and/or auxiliary winch.

7. Method according to claim 6,
wherein
setting the pressing force by means of the control means.

8. Method according to claim 7,
wherein
for the setting of the pressing force, actuating the auxiliary winch and pressing the pile element against the driving helmet while the main winch is stopped and the hammer unit is located in a lower starting position on the mast, and subsequently actuating the main winch and the auxiliary winch by the control means, wherein moving the hammer unit along the mast from the lower starting position into an upper driving position while the pile element is pressed continuously against the driving helmet.

9. Method for driving a pile element into the ground with a pile-driving apparatus according to claim 1,
wherein
operating the auxiliary winch at a predetermined speed and/or pulling force and
for the generation of the pressing force, operating the main winch at a speed and/or pulling force set by the control means.

* * * * *